US005462605A

United States Patent [19]

Szücs

[11] Patent Number: 5,462,605

[45] Date of Patent: Oct. 31, 1995

[54] APPARATUS AND METHOD FOR TREATING SENSITIVE SURFACE, IN PARTICULAR OF SCULPTURE

[76] Inventor: Johann Szücs, Connollystrasse 31, 80809 München, Germany

[21] Appl. No.: 98,453

[22] Filed: Jul. 27, 1993

[30] Foreign Application Priority Data

Aug. 3, 1992 [DE] Germany ..... 42 25 590.2

[51] Int. Cl.[6] ..... B08B 3/02

[52] U.S. Cl. ..... 134/7; 134/102.2; 134/198; 451/38

[58] Field of Search ..... 51/437; 366/176; 134/102, 102.2, 198, 6, 7; 239/433, 525, 526, 527, 543; 451/38, 91

[56] References Cited

U.S. PATENT DOCUMENTS

| | | | |
|---|---|---|---|
| 2,083,851 | 6/1937 | Marcy | 239/433 |
| 2,605,596 | 8/1952 | Uhri | 51/282 |
| 3,881,656 | 5/1975 | Markfelt et al. | 239/433 |
| 4,328,107 | 5/1982 | Wright | 239/433 X |
| 4,562,366 | 1/1986 | Smith | 239/433 |
| 4,815,241 | 3/1989 | Woodson | 239/433 X |
| 5,035,090 | 7/1991 | Szucs | 51/439 |

FOREIGN PATENT DOCUMENTS

| | | | |
|---|---|---|---|
| 0090691B1 | 3/1983 | European Pat. Off. . | |
| 0110529A3 | 6/1984 | European Pat. Off. . | |
| 0171448 | 2/1988 | European Pat. Off. . | |
| 0437168A2 | 7/1991 | European Pat. Off. . | |
| 3204861 | 8/1983 | Germany | 239/433 |
| 85 19 458.1 | 10/1985 | Germany . | |
| 8606183 | 7/1986 | Germany . | |
| 3622292A1 | 1/1987 | Germany . | |
| 4002787A1 | 8/1991 | Germany . | |
| 2159059 | 11/1985 | United Kingdom . | |

*Primary Examiner*—Frankie L. Stinson

*Attorney, Agent, or Firm*—Renner, Otto, Boisselle & Sklar

[57] ABSTRACT

An apparatus for treating, for example cleaning, sensitive, in particular highly contoured surfaces such as those of sculptures of wood, plaster, bronze and the like, comprises a mixing head (1) for mixing media supplied to the mixing head (1) and for spraying a treatment jet (50) formed therefrom. The mixing head (1) comprises a mixing chamber (30) into which under pressure a first jet with a liquid treating agent is introduced via a first supply conduit (10) through an inlet (12) and a second jet is introduced, the jet axis (22) of which is inclined at an angle (γ) to the jet axis (11) of the first jet and extends eccentrically thereto. In this apparatus the inlet (12) for the first jet comprises an inlet opening (14) which is so formed and/or orientated that the jet axis (22) of the second jet intersects the first jet. The treatment of sensitive highly contoured surfaces is carried out according to the invention, in particular using this apparatus, by means of a treatment jet (50) rotating about its generating jet axis (11) and containing at least a treating agent liquid before its atomization.

28 Claims, 2 Drawing Sheets

APPARATUS AND METHOD FOR TREATING SENSITIVE SURFACE, IN PARTICULAR OF SCULPTURE

The invention relates to an apparatus for treating, for example cleaning, sensitive surfaces, in particular highly contoured surfaces such as those of sculptures of wood, plaster, bronze and the like, according to the preamble of claim 1 and a method for treating sensitive highly contoured surfaces according to the preamble of claim 25.

In the treatment of sensitive highly contoured surfaces, as are encountered typically in sculptures, for example, wooden, plaster or bronze figures, the two-fold problem of a both gentle but nevertheless thorough treatment arises. Firstly, the surfaces are sensitive, this being the case in particular with projecting surfaces, for example the nose of a human figure, and in some cases are hardly accessible because due to the surface contour they are hidden behind projections, bends and the like.

For cleaning substantially planar and comparatively insensitive surfaces, blasting methods are known using abrasive particles which are thrown as a jet under high pressure rectilinearly onto the surface to be cleaned.

For the same purpose, i.e. cleaning substantially planar surfaces which however in contrast to the foregoing are sensitive, EP 0 171 448 B1 discloses a method and an apparatus according to which and in which the cleaning takes place by means of a cleaning jet rotating about its central axis. In the cleaning jet atomized water, air and a cleaning agent consisting of solid particles are contained. The known apparatus is formed essentially by a mixing head, into the mixing chamber of which, in each case under pressure, firstly a mixture of water and air is introduced via an atomizing nozzle, and secondly a mixture of air and solid particles via a further supply conduit. The two mixture streams encounter each other in the mixing chamber at an angle and a mutual eccentricity of their respective central axes, mix together and leave the mixing head as rotating cleaning jet.

It is not known to use this nonaggressive method for treating, for example cleaning or polishing or applying a protective liquid, highly contoured surfaces, as encountered for example in wooden or plaster figures in churches. Since the two mixture streams are introduced at an angle and eccentrically to each other into the mixing chamber of the known mixing head, at least one of the two pressurized streams is thrown against the mixing chamber wall opposite its inlet mouth and with increasing service life of the mixing head can result in an undesired material removal in the impingement area. This undesired effect is particularly pronounced because of the mutual eccentricity of the two mixture streams introduced into the mixing chamber because the mixture stream directed onto the mixture chamber wall still has a greater part of its kinetic energy on impact.

The problem underlying the invention is to avoid the disadvantages involved with the methods and apparatuses known in the prior art. In particular, a likewise gentle and thorough treatment of sensitive and highly contoured surfaces is to be made possible. In an apparatus for generating a rotating and thus gentle treatment jet a particularly good mixing and angular momentum transfer is to be achieved in the mixing chamber of a mixing head with simultaneous reduction of abrasion of the mixing chamber wall.

This problem is solved by the subjects of claims 1 and 25.

Advantageous further developments of the invention which are not obvious are claimed in the following subsidiary claims.

By using a blasting method, that is a blasting method in which the jet content rotates about its central axis pointing in the jet propagation direction, the jet particles, that is atomized liquid treating agent and/or solid polishing or abrasive particles, have an effect on the surface to be treated in the form of a material preserving wiping motion. With the use according to the invention of such a blasting method for treating sensitive highly contoured surfaces, for example sculptures, the restoration of such objects can be considerably simplified and because of the saving in time made more economical than the conventionally used purely manual methods, for example scratching out dirt with corresponding manual tools or wiping with cloths. The risk of destruction of a valuable object is reduced.

The step according to the invention of introducing two pressurized jets running inclined to each other and with their respective centre axes eccentric to each other into a mixing chamber of a mixing head in such a manner that the one jet has an extent such that it is intersected by the central axis of the other jet, in particular the cross-sectional area of the second jet is overlapped by the first jet in the common intersection area to a great extent or even substantially completely, provides a good mixing and rotary momentum application for generating a resultant rotation jet. At the same time the wear by material erosion of the mixing chamber wall is counteracted because on coming together the kinetic energies of the two jets are converted extremely effectively into rotational energy and translational energy of the resultant mixture jet and none of the jets can transfer an appreciable part of its kinetic energy to the mixing chamber wall before the collision.

According to the invention, a mixture jet, which may contain a single treating agent or a mixture of different liquid treating agents, is introduced via a first supply conduit through a slit-like inlet opening into the mixing chamber, thereby forming a jet which is extended transversely of the jet propagation direction and can be referred to as a wide jet. Due to its orientation, this wide jet according to the invention covers to a large extent or even completely or almost completely the path of the second jet introduced into the mixing chamber at an inclination angle and eccentrically to the central longitudinal axis of the wide jet. For this purpose the longitudinal axis of the inlet opening has a transverse component to the plane defined by the parallel projections of the jet central axis of the two jets introduced into the mixing chamber onto the intersection. Preferably, the longitudinal axis of said opening is substantially perpendicular to said plane.

The inlet with the slit-opening may for example be configured as simple slit orifice or in a particularly advantageous embodiment as very narrow through opening of a nozzle tapering towards said very narrow opening and thereafter widening again.

The second jet, which can contain a mixture of pressurized gas and solid particles, is introduced into the mixing chamber via a second supply conduit, the through cross-section of which according to the invention widens along its path towards the inlet into the mixing chamber. With otherwise the same mass flow, a reduction of the kinetic energy of said second jet can thereby be achieved.

In a particularly advantageous manner, this effect is brought about by the configuration according to the invention of an abrupt widening. This alone ensures that the second jet in its core region lying eccentrically to the central axis of the first jet, and possibly shooting past the first jet, no longer has any pronounced velocity peak, but an overall turbulent comparatively blunt velocity profile. On meeting the first jet, the second jet or the components thereof therefore has in the jet propagation direction a lower velocity than would be the case with uniform or also with gradually widening configuration of the second supply conduit. Due to the turbulences arising after the sudden widening the jet content has transverse velocity components which in turn contribute to the good mixing and thus also to improving the rotary momentum impact or generation.

According to a preferred embodiment of the invention the widening takes place from a first to a second circular cylindrical passage cross-section of which the diameter ratio lies in the range between 2:3 and 4:5, in particular being about 3:4.

Also, of particular interest in this connection is the ratio of the mixing chamber diameter, the mixing chamber preferably likewise having a circular cylindrical cross-section to the diameter of the inlet of the second supply conduit into the mixing chamber. This ratio is preferably between 4:3 and 6:5, in particular 5:4, so that in the preferred embodiment of the invention the ratio series of about 3:4:5 results between the diameter of the first section of the second supply conduit via the second section thereof with respect to the mixing chamber diameter.

A projection is preferably formed behind the region of the mixing chamber wall lying at the level of the intersection of the two mutually mixing jets, in particular behind the region lying in the extension of the central axis of the second jet. This projection is advantageously made as sharp-edged as possible. This makes it possible to prevent or at least reduce a sliding off of the jet components impinging in this region at an angle to the chamber wall and to promote an early rotation formation.

Preferably, the mixture jet formed in this manner and already in rotation is conducted through a section of the mixing head which adjoins the mixing chamber and is gradually, in particular continuously, tapered, and is thereby constricted. The geometry of this section is dimensioned according to the invention in such a manner that the stretching formed as quotient of the length and—in the case of a preferably cylindrical cross-sectional form—the inlet diameter of the section lies between 4:1 and 8:1, particularly preferably being 5:1. At the same time, the tapering as quotient of inlet and outlet diameter should at the most be 4:1 and preferably only about 2.3:1.

Preferably, said projection is formed in that the tapered section at its mixing-chamber side end has a smaller diameter than the mixing chamber, forming an annular projection. The diameter of the mixing chamber should be reduced in the ratio of about 5:4; at least, however, the projection should project half a millimeter into the opening cross-section.

Advantageously, like the mixing chamber wall itself, the tapered section is formed by a material having a surface which although resistant to abrasion has at the same time adequate roughness to prevent the jet components sliding too easily therealong. Fundamentally, the desired properties can be achieved by using different ceramic materials, so that in particular the tapered section has at least a ceramic surface but the projection itself is formed in particularly abrasive-resistant manner as sintered ring.

Furthermore, it is found advantageous for a section of substantially constant passage cross-section to adjoin the tapering section at the jet outlet side. In this latter section a further homogenization and settling of the jet content takes place.

In the two last sections mentioned the mixture jet is consolidated and made uniform, thereby enabling a treatment jet propagating conically with a small opening angle to be generated, particularly suitable for the main use.

The ratio of the lengths of these two consecutive sections is also significant. The length of the outlet-side section is advantageously at least one sixth, in particular a fifth to a quarter, of the length of the tapered section.

The liquid treating agent is in most cases water. Depending on the treatment, the water may however be replaced by a special washing liquid or a protective liquid, in particular against rust. Possibly, a corresponding mixture of different treating agents may also be used. In the case of cleaning, solid particles are additionally supplied to the mixing head as polishing or abrasive particles. Fundamentally, ice particles may also form these solid particles, either supplying to the mixing head already crystallized ice particles or generating these ice particles in the already atomized mixture jet following the mixing chamber.

According to the invention, a rotating treatment jet is used which has an opening angle of less than 30°, in particular even less than 20°, to ensure that the wiping motion also reaches surfaces which are set back behind projecting surfaces and possibly even partially concealed, and to allow the jet content to act as directly as possible only in such a region.

The invention will be explained in detail hereinafter with reference to a preferred embodiment with the aid of the drawings, wherein.

Figure 1:
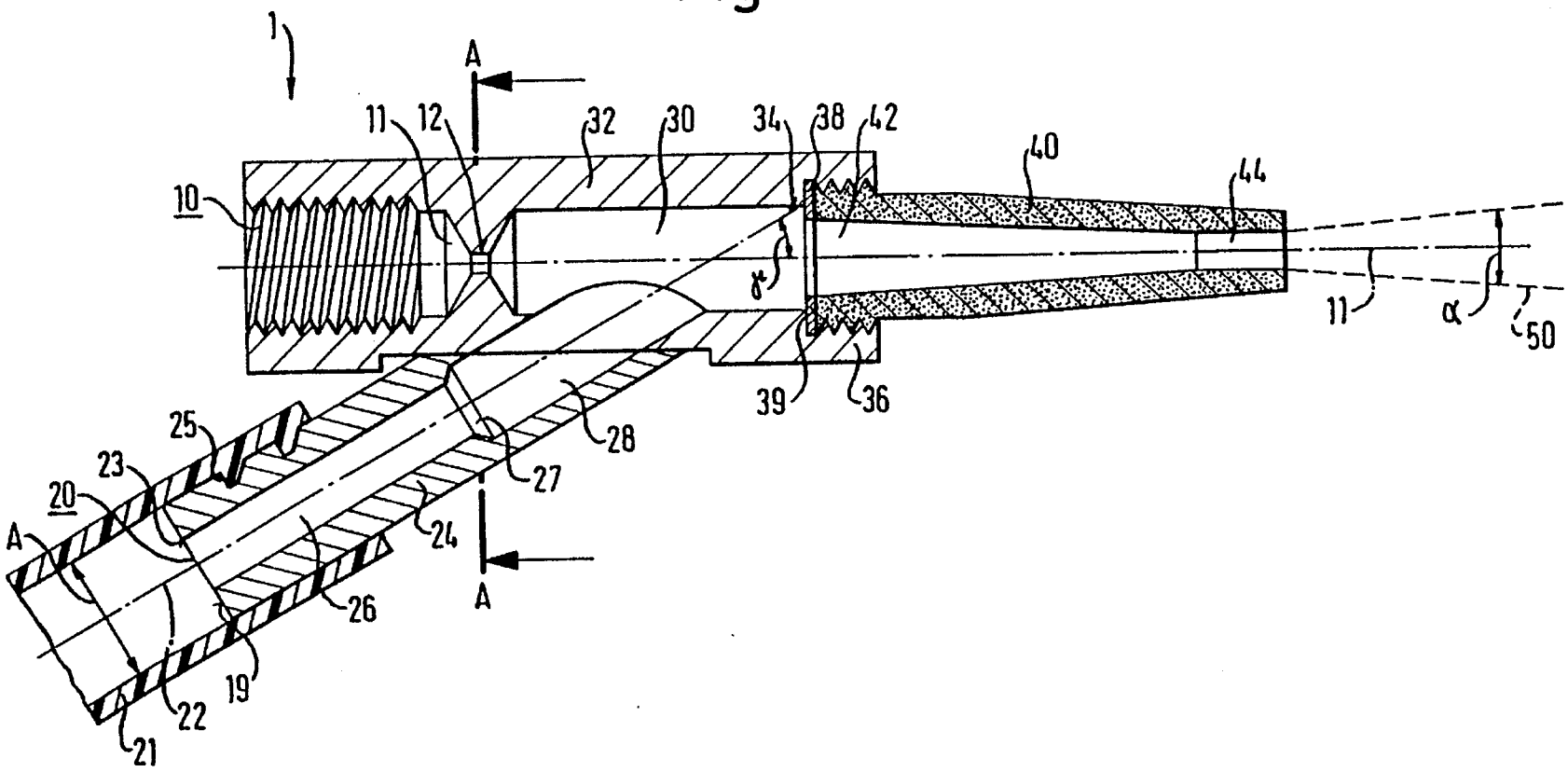
FIG. 1 shows a mixing head in longitudinal section.

The apparatus shown in FIG. 1 and denoted generally as mixing head 1 is supplied with a first jet of a mixture of a liquid treating agent and a pressurized gas via a first supply conduit 10 and via a second supply conduit 20 with a second jet containing a pressurized gas, for which by way of example hereinafter compressed air will always be referred to, and solid particles. The central axis 22 of the second supply conduit 20 is arranged inclined at an angle $\gamma$ to the central axis 11 of the first jet introduced through the first supply conduit 10 via an inlet 12 into the mixing chamber 30. In addition, the central axis 11 and 22 of the two jets extend eccentrically past each other so that the mixture jet formed by the two jets is set in rotation about its jet propagation direction which coincides with the axis 11 of the first jet.

In the example of embodiment the central axis 11 of the first jet introduced via the inlet 12 into the mixing chamber 30 is directed towards the outlet of said mixing chamber 30. In this example the jet central axis 11 even coincides with the axis of symmetry of the rotational-symmetrically formed mixing chamber 30. However, other arrangements for the jet introduction into the mixing chamber are conceivable with suitable arrangement of the two supply conduits 10 and 20 in conjunction with suitably chosen mass and volume ratios of the two jets mixed in the mixing chamber 30, retaining however the inclination angle $\gamma$ and an eccentricity.

The mixture of compressed air and the atomized liquid treating agent, as example of which water is given, set in rotation in the mixing chamber 30 passes after constriction in a section 42 adjoining the outlet of the mixing chamber 30 and gradually tapering, to an outlet section 44 of the mixing head 1. The outlet section 44 is formed as section with a substantially constant cross-section. The treatment jet 50 emerging from the outlet 44 opens conically at an opening angle $\alpha$ of about 20° so that the treatment jet opens at the usual working distance to a cone area corresponding at the most to a 5-Mark piece.

To obtain as intimate as possible a mixing of the first and second jets introduced into the mixing chamber and thus at the same time the best possible rotary momentum impression, the first jet supplied via the first supply conduit 10 is introduced into the mixing chamber 30 in the form of a jet more extended in a transverse direction to its jet central axis 11 and therefore referred to as wide jet. This achieves that the cross-sectional area of the second jet, striking the wide jet eccentrically, is substantially covered by the wide jet and its kinetic energy is thus absorbed in optimum manner. At the same time, the wide jet protects the region 34 of the mixing chamber wall which lies in a straight line extension of the central axis 22 of the second supply conduit 20. Without such a shielding by the wide jet the second jet shooting past would strike the chamber wall in the region 34 as could certainly be the case for example with a mixing head constructed according to EP 0 171 448 B1. This is all the more true the smaller the dimensions of a mixing head are made. Depending on the nature of the jet components contained in the second jet, which can include in particular solid polishing or abrasive particles, without the shielding described by the first jet configured as wide jet there would be a danger of an appreciable material erosion of the wall region 34.

Figure 2:
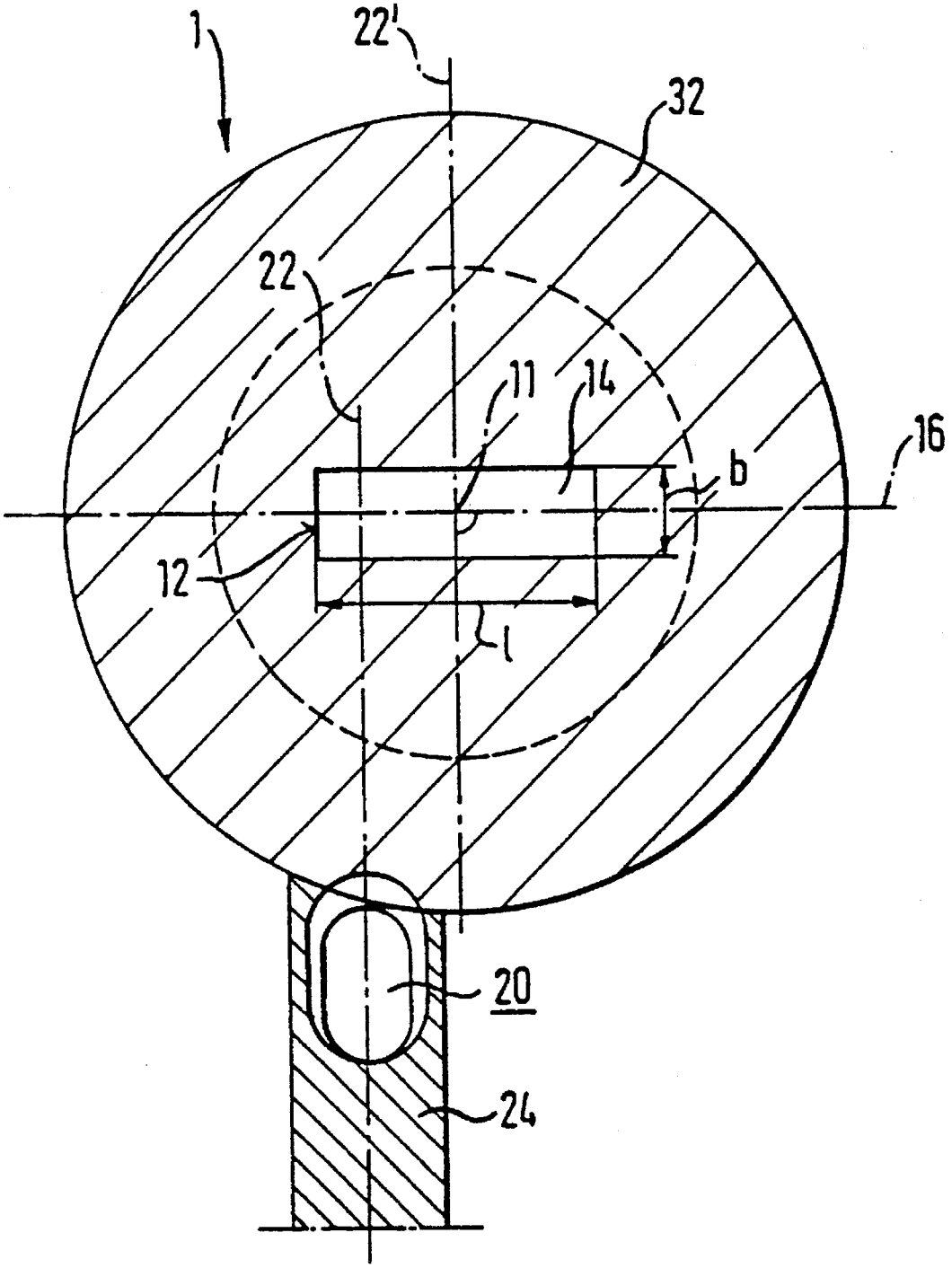
FIG. 2 shows an inlet having a slit-like inlet opening along the section A—A of FIG. 1.

In FIG. 2 the jet 12 is shown at its narrowest point in the section A—A. This narrowest point is formed by a slit-like nozzle opening 14 which is rectangular in the example of embodiment and the longitudinal axis 16 of which is substantially perpendicular to the plane which passes through the central longitudinal axis 11 of the nozzle 12 or the first jet and the parallel projection 22' of the central axis 22 of the second supply conduit, i.e. the direction of the second jet introduced into the mixing chamber 30. However, the longitudinal axis 16 of the nozzle opening 14 could also extend to an extent to be defined at another suitable inclination angle to said plane.

As illustrated in FIG. 1, the second supply conduit 30 is widened towards the inlet to the mixing chamber 30. The widening is made as abrupt widening 27 so that a first section 26 of the second supply conduit 20 with constant passage cross-section widens abruptly to an adjoining wider section 28 likewise having a constant but greater passage cross-section. At the widening 27, which for production reasons opens at an angle of about 60° but would ideally be a smooth transition, turbulences occur which reduce the momentum component of the second jet directed in the direction of the central axis 22. The second jet therefore impinges on the flat side of the wide jet with a pronounced turbulent flow profile. This step makes a considerable contribution to the reduction of wear of the region 34 whereas at the same time, due to the transverse velocity components of the jet content produced by said turbulences, the mixing in the mixing chamber 30 is intensified and the angular momentum transfer is not impaired. Possibly, in configuration of such a second jet, in particular with the geometry of the mixing head to be described in more detail below, a first jet generated in already known manner, for example according to the teaching of EP 0 171 448 B1 could even be used.

The described formation of the mixing head 1 is favourable in particular for its use for treating highly contoured surfaces such as sculptures or figures of wood, plaster, bronze and the like, which frequently have pronounced crevices and very uneven surfaces, so that the tool used, i.e. the mixing head 1, must be made in correspondingly small dimensions which can certainly be referred to as miniature. For if the two jets impinging on each other in the mixing chamber were relatively highly bundled, then because of the eccentricity of their respective central axes they could hardly be prevented from shooting past each other.

The opening angle α of the emerging treatment jet 50 is so dimensioned that the jet impinging on the surface to be treated at the typical working range has an area of less than that of a five-Mark piece, i.e. less than about 7 $cm^2$. The opening angle α of the treatment jet 50 is about 20°. It is always less than 30°.

To form such a treatment jet 50, following the mixing chamber 30 the ideally gradually tapering section 42 with a stretch ratio of about 5:1 is formed. The term stretching means the ratio of the length to the diameter of said cylindrical section 42.

The tapered section 42 merges on the outlet side into a wider cylindrical section 44 of constant passage cross-section. As was discovered in the course of the development work, in this latter section 44 a further homogenization of the mixing and a settling of the movements of the jet content not taking place in the direction of rotation occur.

The two sections 42 and 44 are inserted as one-part sleeve 40 of ceramic material into a socket 36 of the mixture chamber housing 32. On the chamber side the tapered section 43 bears with formation of a shoulder 39 on a sintered ring 38 with a sharp edge. The extension of the central axis 22 of the second supply conduit 20 points into or just in front of the region 34 lying between the sintered ring 38 and the mixing chamber wall. The shoulder 39 formed behind the impingement region 34 by the sintered ring 38 prevents the impinging jet components from sliding along the chamber wall, which would otherwise undesirably retard the rotation formation and further promotion.

A decisive part is also played by the matching of the dimensions of the individual components of the mixing head 1, in particular the length and cross-sectional area ratios of consecutive flow cross-sections and the ratios formed from the lengths and cross-sectional areas or diameters and referred to as stretching. In this connection express attention is drawn to FIG. 1 with the scale 1:1.4.

Thus, a tube member 24 forming the second supply conduit 20 with the two sections 26 and 28 has a half-inch outer diameter with a suitable connection region 25 for connecting standard compressed gas sources and hoses. It was found in tests that the end face 27 at the free end of the tube member 24 should be as plane as possible. It therefore extends planar up to the internal diameter of a pushed-on hose 21 and is chamfered only to a slight extent at the outer edge simply for protection thereof from damage. Likewise, the end face 27 extends planar as close as possible up to the edge of the first section, made as simple bore, in order to form as a result in ideal manner an abrupt constriction 23 from the cross-section of the hose 23 down to the first section 26. Tests have shown that a rounding and even an excessive chamfering of the end face 27 surprisingly exert an appreciable undesired influence on the flow profile of the second jet on introduction thereof into the mixing chamber 30.

The diameter of the first section 26 of the second supply conduit 20 is about 6 mm whilst the second widened section 28 has a diameter of about 8 mm. The length ratio of these two sections 26 and 28 is about 3:2, the length of the chamber-side section 28 being taken as the length of its central axis up to the intersection with the mixing chamber wall and the first section 26 being made in a length of about 20 to 40 mm, in particular about 30 mm.

The diameter of the cylindrical mixing chamber 30 in the example of embodiment is about 10 mm. The substantially rectangular nozzle opening 14 has a length 1 of about 1.2 mm and a width d of about 0.6 mm.

At its mixture-chamber-side inlet the tapering section 42 has a diameter of about 8 mm which tapers to the outlet section 44 down to about 3.5 mm. The outlet section 44 itself then has the constant diameter of about 3.5 mm. Its outer outlet edge is sharp. It is possibly additionally again formed in particularly abrasive-resistant manner. All the diameter particulars relate to cylindrical cross-sectional areas.

It has been found that such a mixing head is also very well suited for cleaning aluminum surfaces, both anodized aluminum and coated aluminum as is used for building facades.

Up to now such aluminum surfaces had to be cleaned by hand or with the help of chemical cleaning agents. The requirement that only a maximum of 3 μm of the aluminum surface may be removed with each cleaning process is not met as a rule with the usual cleaning methods.

If the mixing head described here is used in connection with a fine-grained cleaning medium, sensitive aluminum surfaces can also be cleaned by machine without chemical cleaning agents having to be used.

The material which comes under consideration as fine-grained cleaning medium is that described in European patent application 0 374 291, namely a mineral jet material with a hardness (Mohs' hardness) of maximum 4 and with a diameter of 0.01 to 1 mm. An especially suitable material is dolomite.

An alternative is also pumice powder or a mixture of dolomite with pumice powder.

While the cleaning of common surfaces requires about 2.3 $m^3$ air/min., a considerably higher proportion of air must be used when cleaning aluminum surfaces, namely a proportion of air of between 3.2 and 4.2 $m^3$/min.

Tests have shown that when using dolomite as jet material in this cleaning process only about 0.5 μm surface is removed with each cleaning procedure, i.e. the above-mentioned standard is fulfilled.

I claim:

1. Apparatus for treating, in particular cleaning, sensitive surfaces, in particular highly contoured surfaces such as those of sculptures of wood, plaster, and bronze, comprising:

a) a mixing head (1) for mixing media supplied to the mixing head (1) and for spraying a treatment jet (50) formed therefrom, b) a first jet containing a liquid treatment agent being introduced under pressure into a mixing chamber (30) of the mixing head (1) via a first supply conduit (10) through an inlet (12) and c) via a second supply conduit (20) a second jet being introduced, the jet axis (22) of which is inclined at an angle (y) to the jet axis (11) of the first jet and extends eccentrically thereto, d) and wherein the inlet (12) has an inlet opening (14) which is slit-like and oriented so that the first jet is relatively wide so as to substantially overlap the cross-sectional area of the second jet in an intersection region of the first and the second jets.

2. Apparatus according to claim 1, characterized in that the inlet opening has a transverse component to a plane which is defined by the parallel projections of the jet axes (11; 22) of the first and second jet onto the intersection region and the longitudinal axis (16) of the inlet opening (14) is substantially perpendicular to the plane defined.

3. Apparatus according to claim 1, characterized in that the central axis (11) of the first jet passing through the inlet opening (14) is directed substantially towards the outlet of the mixing chamber (30), in particular that the central axis (11) thereof coincides with the axis of symmetry of the mixing chamber (30), the mixing chamber (30) being rotational-symmetrically formed.

4. Apparatus according to claim 1, characterized in that the length (1) of the inlet opening (14) is 1.5 to 4 times, in particular about twice the width (b) thereof.

5. Apparatus according to claim 4, characterized in that the length (1) of the inlet opening (14) is 0.8 to 1.8 mm, in particular about 1.2 mm, and the width (b) 0.2 to 1.2 mm, in particular about 0.6 mm.

6. Apparatus according to claim 1, characterized in that the inlet (12) is formed as slit orifice or as extremely narrow passage opening of a nozzle tapering and then widening again.

7. Apparatus according to claim 1, characterized in that in the path of the second supply conduit (20) the passage cross-section widens towards the inlet into the mixing chamber (30).

8. Apparatus according to claim 7, characterized in that the widening is formed as abrupt widening (27), in particular as abrupt widening (27) from a first section (26) to a second section (28) having in each case a constant cylindrical passage cross-sectional area.

9. Apparatus according to claim 8, characterized in that the two sections (26; 28) are cylindrical and the ratio of their diameters lies in the range between 2:3 and 4:5 and in particular is about 3:4.

10. Apparatus according to claim 8, characterized in that the second supply conduit (20) is formed by a cylindrical tube member (24) having the first section (26) at the connection-side end, which is insertable into a supply conduit (21) for treating agents and for forming an abrupt cross-sectional constriction (23) has an outer diameter (A) which is at least 1.5 times, in particular about twice, the diameter of the first section (26).

11. Apparatus according to claim 8, characterized in that the second supply conduit (20) is formed by a tubular member (24) with the first section (26) at the connection-side end which has an almost completely planar end face (27).

12. Apparatus according to claim 8, characterized in that the ratio of the second section (28) of the second supply conduit (20) opening into the mixing chamber (30) to the diameter of the circular mixing chamber (30) is 3:4 to 5:6, in particular about 4:5.

13. Apparatus according to claim 8, characterized in that the first and second supply conduits (10; 20) are formed for simple connection to the connections available on site, in particular half-inch connections, for treating agents, in particular water and compressed air.

14. Apparatus according to claim 1, characterized in that to reduce or prevent a sliding of the jet components upstream from the intersection region of the two jets a projection (38) projects from the chamber wall into the chamber (30).

15. Apparatus according to claim 14, characterized in that the projection (38) is formed by an encircling shoulder, in particular by a sintered ring.

16. Apparatus according to claim 15, characterized in that the shoulder (38) projects at least half a millimeter, in particular one millimeter, into the mixing chamber (30).

17. Apparatus according to claim 1, characterized in that the mixing head (1) tapers gradually following the mixing chamber (30), in particular following the shoulder (38).

18. Apparatus according to claim 17, characterized in that the tapered section (42) has a stretch ratio, formed as quotient of the length and diameter of said section (42), of 4:1 to 8:1, in particular about 5:1.

19. Apparatus according to claim 17, characterized in that the tapered section (42) has a cylindrical cross-section and tapers towards the mixing head outlet with regard to its diameter at the most by a factor of 4, in particular to about 2.3 times.

20. Apparatus according to claim 1, characterized in that following on the tapered section (42) the mixing head (1) has on the outlet side a section (44) of constant passage cross-section, in particular cylindrical cross-section.

21. Apparatus according to claim 20, characterized in that the outlet-side section (44) has a length which is at least one sixth, in particular one fifth to a quarter, of the length of the tapered section (42).

22. Apparatus according to claim 1, characterized in that the inner walls of the mixing head (1) coming into contact with the jet components are formed by ceramic materials.

23. Apparatus according to claim 1, wherein the first jet is relatively wide in the intersection region compared to the second jet such that substantially all kinetic energy of the first and second jets is converted into rotational energy and translational energy about the jet axis of the first jet and substantially little kinetic energy of the first and second jets is transferred normal to a wall of the mixing chamber.

24. Method for treating, for example cleaning, sensitive highly contoured surfaces such as those of sculptures of wood, paster, and bronze, using an apparatus comprising a mixing head for mixing media supplied to the mixing head and for spraying a treatment jet formed therefrom, a first jet containing a liquid treatment agent being introduced under pressure into a mixing chamber of the mixing head via a first supply conduit through an inlet and via a second supply conduit a second jet is introduced, the jet axis of which is inclined at an angle ($\gamma$) to the jet axis of the first jet and extends eccentrically thereto, and the inlet having an inlet opening which is slit-like and oriented so that the first jet is relatively wide so as to substantially overlap the cross-sectional area of the second jet in an intersection region of the first and the second jets, and said method being carried out by means of the treatment jet.

25. Method according to claim 24, characterized in that the treatment jet (50) contains water, a special washing or protective liquid or a mixture thereof.

26. Method according to claim 24, characterized in that the treatment jet (50) contains solid particles, in particular solid and/or ice particles.

27. Method according to claim 24, characterized in that the jet opening angle ($\alpha$) is less than 30°.

28. Method according to claim 24, characterized in that it is used for the cleaning of aluminum surfaces.

* * * * *